US006905339B2

(12) United States Patent
DiMare et al.

(10) Patent No.: US 6,905,339 B2
(45) Date of Patent: Jun. 14, 2005

(54) VIRTUAL SPORT INSTRUCTION

(76) Inventors: Mark DiMare, 732 Cable Beach La., N. Palm Beach, FL (US) 33410; Joe DiMare, 6 Oyster Bay, North Palm Beach, FL (US) 33408

( * ) Notice: Subject to any disclaimer, the term of this patent is extended or adjusted under 35 U.S.C. 154(b) by 337 days.

(21) Appl. No.: 10/340,514

(22) Filed: Jan. 10, 2003

(65) Prior Publication Data

US 2004/0137415 A1 Jul. 15, 2004

(51) Int. Cl.[7] ..... A63A 71/00
(52) U.S. Cl. ..... 434/247; 473/266
(58) Field of Search ..... 434/247–258; 473/131, 266

(56) References Cited

U.S. PATENT DOCUMENTS 4,337,049 A 6/1982 Connelly
5,184,295 A 2/1993 Mann
5,249,967 A 10/1993 O'Leary et al.
5,486,001 A 1/1996 Baker
5,603,617 A 2/1997 Light
5,823,786 A 10/1998 Easterbrook
5,879,246 A 3/1999 Gebhardt et al.
5,882,269 A 3/1999 Lewis
5,947,742 A 9/1999 Katayama
5,984,684 A * 11/1999 Brostedt et al. ..... 434/252
6,126,449 A 10/2000 Burns
6,261,189 B1 7/2001 Saville et al.
6,285,379 B1 9/2001 Gallery
6,402,633 B1 6/2002 Hsiung et al.
6,416,419 B1 7/2002 Foresi
6,431,994 B1 8/2002 Firth
6,503,086 B1 * 1/2003 Golubov ..... 434/247
2001/0034730 A1 10/2001 Bhandari et al.
2002/0031753 A1 3/2002 Yanai et al.

* cited by examiner

*Primary Examiner*—Xuan M. Thai
*Assistant Examiner*—Kathleen Christman
(74) *Attorney, Agent, or Firm*—Akerman Senterfitt

(57) ABSTRACT

A sport performance evaluation method and system. The method includes storing a user-defined physical profile, displaying a set of images where each image in the set depicts a different variation of an element of imperfect sport performance, and selecting at least one image in the set most closely depicting an element of imperfect sport performance exhibited by a user who is associated with the user-defined physical profile. The method also includes diagnosing at least one cause for the imperfect sport performance based upon the stored at least one selected image and the stored user-defined physical profile. The system can include a user-defined physical profile and at least one set of images depicting an element of imperfect sport performance where each image in the set depicts a different variation of the element. The system can also include at least one data repository and at least one computing device.

18 Claims, 3 Drawing Sheets

VIRTUAL SPORT INSTRUCTION

BACKGROUND OF THE INVENTION

1. Technical Field

The present invention relates to the improvement of sport performance, and more particularly to computerized systems for diagnosing sport performance problems.

2. Description of Related Art

In the general field of sport performance, there is a variety of information directed to improving one's performance while participating in a sport. Books, brochures, videos, and Web sites contain sport performance information relating to proper posture, throwing or kicking motion, proper grip, and the like which are all elements of sport performance. While this information may provide insight into a "proper" technique used in a particular sport, none of these materials are directed to specific individuals having specific needs or specific physical limitations. For example, while the "proper" swing for a professional baseball player can be to swing a bat with a particular order and combination of feet, hips, head, wrist, arm, and shoulder movement, such a swing can be considered improper for a child learning how to hit a baseball with a bat.

Consequently, athletes often turn to sport instruction literature and other sources for information regarding the improvement of sport performance. Nevertheless, sport performance improvement information contained in any one particular source must be searched by a user in order to find relevant portions. While many sources containing information for improving one's performance may have an organizational structure such as an index or a table of contents to direct users to relevant information, the user must still search through the source to find relevant information. Although some users may find relevant information by using an index or a table of contents, other individuals may not be able to find the relevant information because that user may not know what key words to look for in an index or a table of contents.

Although some users will be able to use the organizational structure of an information source to find information regarding a particular subject relating to sport performance, a user still must sort through the information and find the information relevant to that particular user. The user must be able to separate relevant information from information that may not be applicable to that particular user. For a user without experience or knowledge in an area of sport performance, this can be a daunting task.

Instead of relying upon information sources for improving sport performance, some users engage the advice of a personal trainer. A personal trainer can offer the advantages of tailoring information to a specific user and individualizing instruction for a user. The personal trainer can consider many factors gained through first hand observation including age, physical fitness, and current technique to evaluate the sport performance of a user. By combining information regarding the user and information relating to sport improvement that is known by the personal trainer, the personal trainer can analyze the sport performance of a user and recommend certain adjustments or practice routines for improvement. If the personal trainer is knowledgeable in a particular area of concern to the user and the personal trainer makes accurate assessments while observing the user, the personal trainer can provide valuable information and instructions to help the user improve sport performance.

Still, while a personal trainer can provide individualized attention and instruction, there are limits and disadvantages to using a personal trainer for improving sport performance. One such notable limitation can include the limited amount of time during which a personal trainer can spend with a particular student. Another important limitation can include the reality that a personal trainer can only give attention to one student, or a limited group of students, at one time.

Recognizing the inherent deficiencies of personalized training, some have proposed alternatives. For instance, U.S. Patent Application Publication No. U.S. 2001/0034730 A1 to Bhandari et al. ("Bhandari") discloses an automated training system and method for providing personalized instruction or advice to a plurality of users. To that end, Bhandari utilizes data mining techniques to find hidden patterns in sport performance data. Based upon those hidden patterns a rule-based advice sub-module can generate advice depending on how a sport performance situation has been characterized. Notably, in Bhandari, the hidden patterns can be prioritized so that the advice sub-module can generate a single set of advice at one time.

It will be recognized by one skilled in the art that while the teachings of Bhandari address some of the deficiencies of the state of the art recited herein, Bhandari, too, suffers from many of those deficiencies. Specifically, while Bhandari collects user specific attributes, the rule sets that are used to mine data for hidden patterns are generated from experts describing common and uncommon errors made by users and standard techniques to avoid these errors. Therefore, because the rule sets are not generated with a respect to individual attributes of a user, Bhandari stops short of offering automated personalized instruction. Specifically, these rule sets have the same limitations found in a general book, with the limitation being that the rule sets (or the information in a book) only account for standard errors and techniques, not individualized characteristics such as height, weight, and any disabilities. More importantly, the rules are updated overtime, allowing the same faulty analysis to occur until the rules are changed.

The teachings of Bhandari remain deficient in as much as it can be difficult for a user to characterize specific elements of sport performance. Specifically, in some instances, a user may not be able to use a word description to properly describe an element of sport performance. Finally, although Bhandari stores previously given advice in an advice history, this advice history can be used only to determine situations where the same advice was given previously and not to affect the analysis in generating subsequent advice. Thus, Bhandari fails to eliminate the deficiencies of the prior art. Consequently, while the system in Bhandari attempts to reduce the reliance on a personal trainer, limiting the use of the advice history results in a user still having to rely upon a personal trainer.

SUMMARY OF THE INVENTION

The present invention concerns a sport performance evaluation method and system. The method includes the steps of storing a user-defined physical profile and displaying a set of images where each image in the set depicts a different variation of an element of imperfect sport performance. Also include are the steps of selecting at least one image in the set most closely depicting an element of imperfect sport performance exhibited by a user who is associated with the user-defined physical profile. The method also includes diagnosing at least one cause for the imperfect sport performance based upon the at least one selected image and the stored user-defined physical profile.

The method can also include the step of storing at least one environmental characteristic where the diagnosing step is additionally based upon the at least one stored environmental characteristic. Additionally, the method can include storing secondary data where secondary data includes at least one of additional user-defined physical profile data, at least one additional selected image, and at least one additional environmental characteristic. The diagnosing step can also be based upon the stored secondary data.

In one embodiment, the method can include the step of generating at least one of a lesson and an evaluation summary where the lesson and the evaluation summary are based upon the diagnosis. Additionally, at least one of the lesson and the evaluation summary can be stored where the diagnosing step can be based upon at least one of the stored lesson and the stored evaluation summary. The method can also include the step of presenting at least one of the stored lesson and the stored evaluation summary.

In another embodiment, the method can include the step of storing in the data repository a post evaluation survey where the diagnosing step can be additionally based upon the stored post evaluation survey. Additionally, secondary data can also be stored where secondary data includes at least one secondary post evaluation survey and the diagnosing step can be additionally based upon the stored secondary data.

In yet another embodiment, the method can include the step of detecting at least one of an illogical selection of the at least one image, an illogical user-defined physical profile, and an illogical post evaluation survey. Additionally, the method can include the step of generating at least one user diagnosis instruction for instructing the user to provide at least one user diagnosis result. The method can also include the step of storing at least one user diagnosis result where the diagnosing step can be additionally based upon the stored at least one user diagnosis result.

In accordance with the inventive arrangements, the system for sport performance evaluation can include a user-defined physical profile, at least one set of images depicting an element of imperfect sport performance where each image in the set depicts a different variation of the element, and at least one data repository configured to store at least the at least one selected image and the user-defined physical profile. The system can also include at least one computing device coupled to the at least one data repository and programmed to perform a sport performance evaluation based upon at least the stored at least one selected image and the stored user-defined physical profile.

In one embodiment, the system can also include at least one of at least one lesson, at least one evaluation summary, at least one post evaluation survey, at least one lesson history, at least one environmental characteristic, at least one secondary data, at least one user diagnosis instruction, and at least one user diagnosis result. The at least one lesson, the at least one evaluation summary, the at least one post evaluation survey, the at least one lesson history, the at least one environmental characteristic, the at least one secondary data, the at least one user diagnosis instruction, and the at least one user diagnosis result can be stored in the at least one data repository. Additionally the at least one computing device can be programmed to perform a sport performance evaluation based additionally upon at least one of the stored at least one lesson, the stored at least one evaluation summary, the stored at least one post evaluation survey, the stored at least one lesson history, the stored at least one environmental characteristic, the stored at least one secondary data, the stored at least one user diagnosis instruction, and the stored at least one user diagnosis result.

In another embodiment, the system can also include at least one user interface. The at least one user interface can be configured to accept at least one of the user-defined physical profile, a selection of the at least one image depicting an element of imperfect sport performance, the at least one post evaluation survey, the at least one environmental characteristic, the at least one secondary data, and the at least one user diagnosis result. The at least one user interface can also present at least one of the stored user-defined physical profile, the stored at least one set of images depicting an element of imperfect sport performance, the stored at least one lesson, the stored at least one lesson history, the stored at least one evaluation summary, the stored at least one post evaluation survey, the stored at least one environmental characteristic, the stored at least one secondary data, and the stored at least one user diagnosis instruction. The system can also include a plurality of networked computing devices where at least one computing device can be configured for user access.

DETAILED DESCRIPTION OF THE PREFERRED EMBODIMENTS

A sport performance evaluation system and method are provided in accordance with the inventive arrangements. The sport performance evaluation system and method can perform a sport performance evaluation without the need for a device, such as a video camera, to view the user engaging in a sport. Additionally, the sport performance evaluation method and system can perform an evaluation without a personal trainer or instructor having viewed the user engaging in the sport. Finally, the sport performance evaluation method and system can allow the user to enhance their sport performance.

Figure 1:
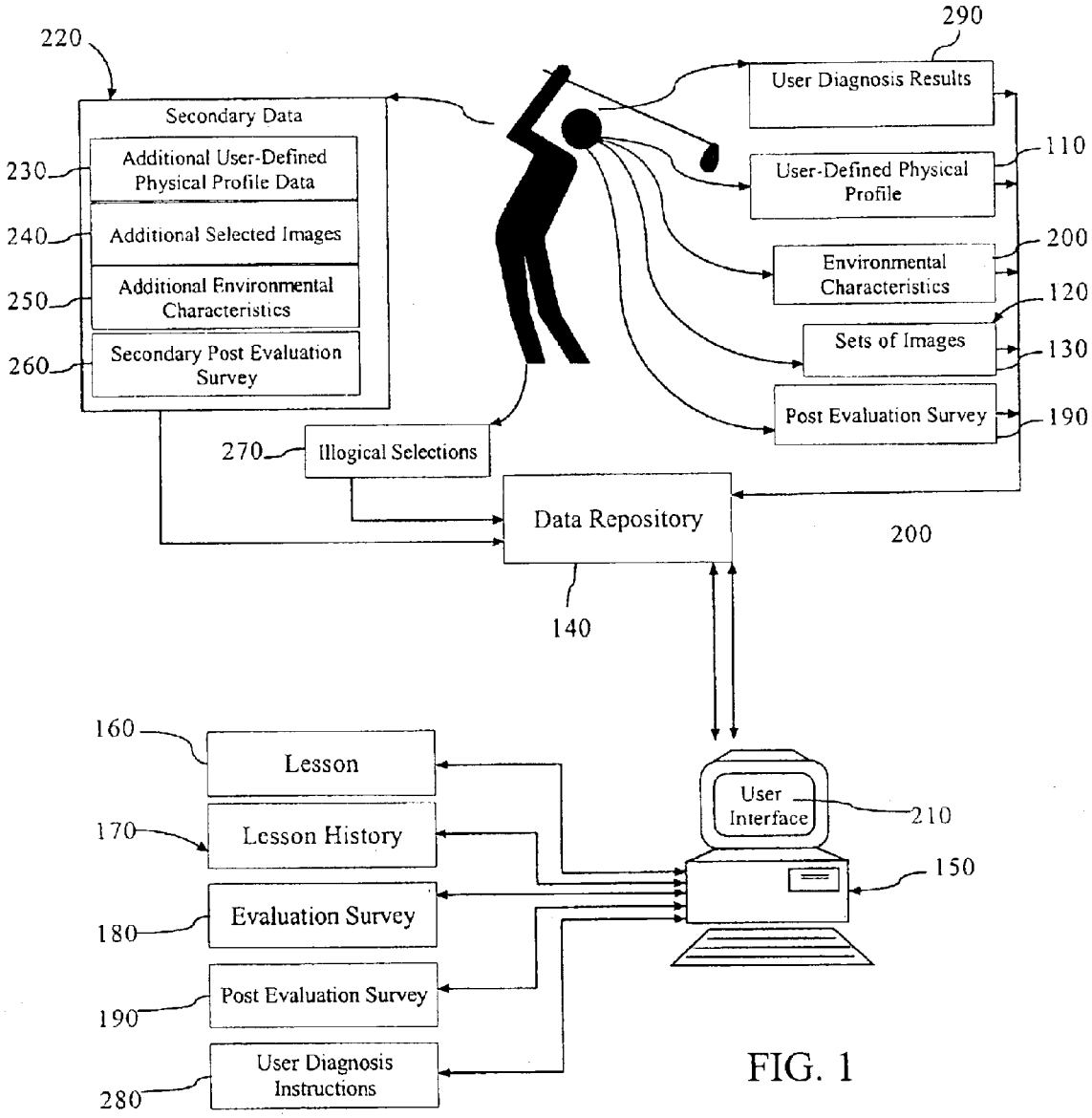
FIG. 1 is a pictorial illustration depicting a system for providing sport performance evaluation in accordance with the inventive arrangements.

FIG. 1 is a pictorial illustration depicting a system for providing sport performance evaluation in accordance with the inventive arrangements. The sport performance evaluation system 100 can include a user-defined physical profile 110 and one or more sets 120 of images 130 depicting an element of imperfect sport performance, where each image 130 in the set 120 depicts a different variation of the element. In operation, one or more images 130 can be selected for the sport performance evaluation. Additionally, the one or more images 130 and the physical profile 110 can be stored in one or more data repositories 140 as data.

The system 100 can also include one or more computing devices 150 for performing a sport performance evaluation based upon data stored in the data repository 140. In performing a sport performance evaluation, the computing device 150 can diagnose one or more causes for the imperfect sport performance based upon the stored one or more selected images 130 and the stored user-defined physical profile 110. Nevertheless, as will be discussed later, the computing device 150 can also diagnose at least one cause for the imperfect sport performance based on all data stored in the data repository 140.

In performing a sport performance evaluation, the computing device 150 can generate a lesson 160, a lesson history 170, an evaluation summary 180, and a post evaluation survey 190 for completion by the user which can all be stored in the data repository 140. Although the system 100 can perform a sport performance evaluation based only upon the stored user-defined physical profile 110 and the stored one or more selected images 130, the sport performance evaluation can also be based on any data stored in the data repository 140. Therefore, the system 100 can include and perform a sport performance evaluation based on the stored user-defined physical profile 110, the stored one or more selected images 130, the stored one or more lessons 160, the stored one or more lesson histories 170, the stored one or more evaluation summaries 180, and the stored one or more post evaluation surveys 190. Additionally, the system 100 can also include one or more environmental characteristics 200, such as playing surface conditions, wind, humidity, rain, snow, and temperature, which can be stored in the data repository 140, and therefore, affect the sport performance evaluation. Additionally, as will be discussed later, the system 100 can also include a at least one user interface 210, secondary data 220, user diagnosis instructions 280, and user diagnosis results 290.

The computing device 150 can include any device that can accept information, such as digital and analog data, and can manipulate that information for some result based on a program or sequence of instructions on how data is to be processed. The computing device 150 can include suitable logic circuitry, a microprocessor, other appropriate hardware, and suitable software for performing an analysis of the data in the data repository 140. The computing device 150 can also include a network of computing devices 150 where one or more computing devices 150 can be configured for user access. The computing device 150 can also include a variety of computing devices 150 such as a personal computer, a personal digital assistant, a tablet personal computer, a server, and the combination of a terminal networked with a processing device; however, the invention is not limited in this regard as any suitable computing device 150 can be used. Nevertheless, it should be noted that a mobile computing device 150 can provide the added benefit of allowing the user to use the computing device in a setting where sport normal occurs, such as on a soccer field, a golf course, and a golf driving range. Briefly, the computing device 150 can be configured to find relationships and patterns among the data stored in the data repository 140. The finding of relationships and patterns among the data will be discussed later.

The data repository 140 can include any suitable structure for storing data, such as a hard drive, a cluster, flash memory, and random access memory; however, it should be obvious to one skilled in the art the invention is not limited in this regard as any suitable form of a data repository 140 can be used. It should also be noted that the data repository 140 can be included with the computing device 150. Alternatively, the data repository 140 can be separate from the computing device 150 and can be linked to the computing device 150 through conventional hardwire or through suitable circuitry permitting wireless communications over a wireless communications link.

Figure 2A:
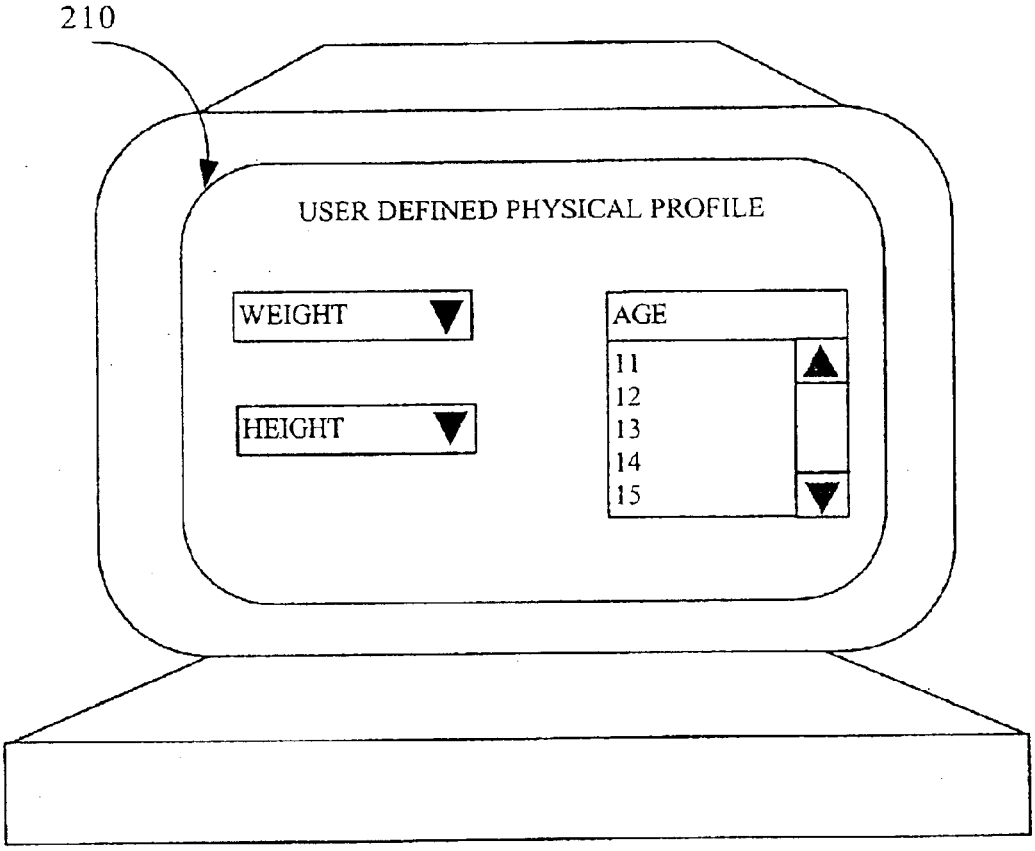
FIG. 2A is an exemplary user interface formatted for presenting data and accepting user input and commands in accordance with the inventive arrangements.
Figure 2B:
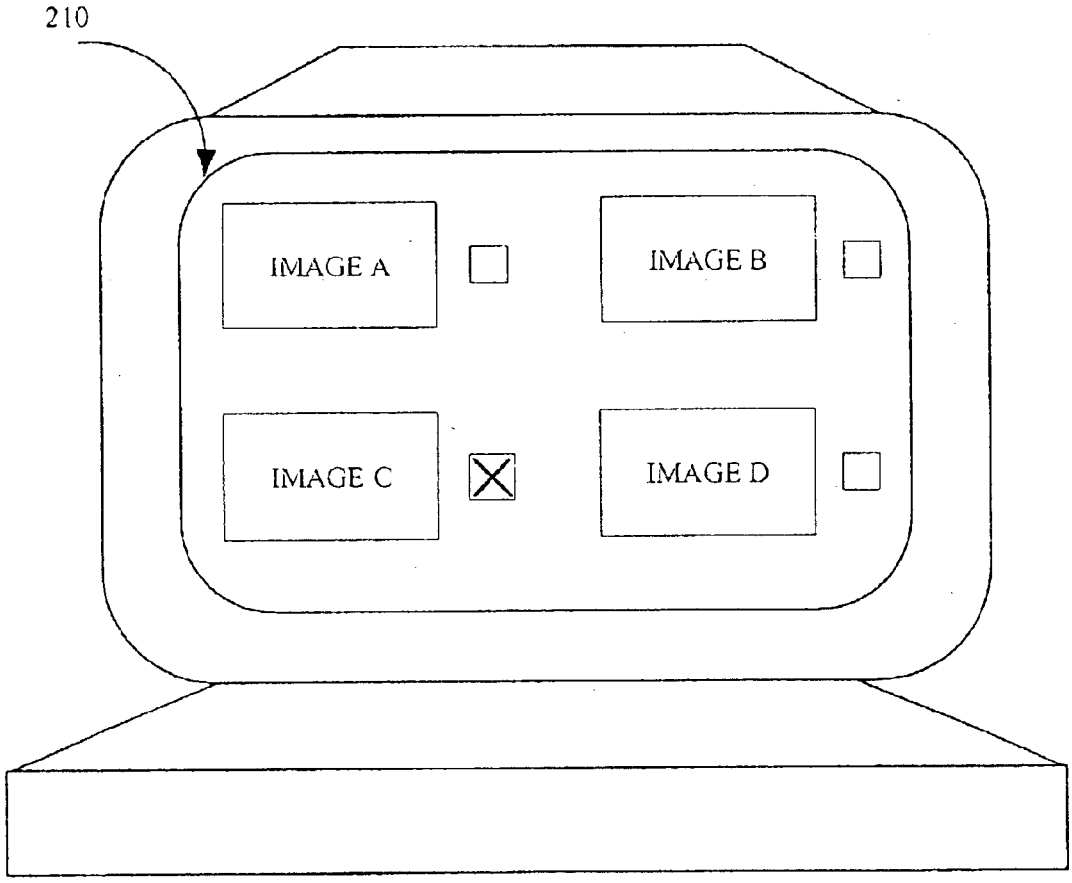
FIG. 2B is another exemplary user interface formatted for presenting data and accepting user input and commands in accordance with the inventive arrangements.

FIGS. 2A and 2B are exemplary one or more user interfaces 210 formatted for presenting data and accepting user input and commands in accordance with the system 100. As shown in FIGS. 2A and 2B, a user interface 210 can be provided which can include a format for presenting data to a user, a format for accepting user input and accepting user commands, and a combination thereof. When presenting data to the user, the user interface 210 can present one or more of the stored user-defined physical profile 110, one or more sets 120 of the images 130, one or more stored selected images 130, one or more stored lessons 160, one or more stored lesson histories 170, one or more stored evaluation summaries 180, one or more stored post evaluation surveys 190, and one or more stored environmental characteristics 200. Alternatively, the user interface 210 can be configured to accept data for a user-defined physical profile 110, a selection of one or more images 130, data for the user post evaluation survey 190, data for the environmental characteristics 200, secondary data 220, and data for the user diagnosis results 290. In such configurations, the accepted data and selections can be stored in the data repository 140, and therefore, can affect the sport performance evaluation.

As an example, the user-defined physical profile 110 can be provided via the user interface 210. The user-defined physical profile 110 can include user physical attributes that can be associated with a sport athlete and user physical attributes that can affect the user's sport performance. The user-defined physical profile 110 individualizes the sport performance evaluation to a specific individual with specific physical attributes. Such attributes can include the age, height, weight, strength, range of motion for any particular movement, and any disabilities of the user. However, the invention is not limited in this regard as any other suitable physical attribute can be included.

The user-defined physical profile 110 can be customized for a specific sport. A customized user-defined physical profile 110 can include and exclude particular attributes dependent on whether an attribute is relevant or not to a specific sport. For example, in the sport of golf, a range of shoulder motion may be an important attribute in performing an evaluation of sport performance, while such an attribute may not be relevant for performing an evaluation for a soccer user. Although some attributes may be relevant for a variety of sports, such as age and weight, no single attribute is necessary for performing a sport performance evaluation. Therefore, the user-defined physical profile 110 can be customizable for a particular sport.

The user-defined physical profile 110 is provided by the user; however, the user only provides the attributes. The user can provide the attributes via accessing a user interface 210; nevertheless, the user does not decide which attributes to provide. Therefore, although accessing a user interface 210 may not be necessary, accessing a user interface 210 to input attributes of the user-defined physical profile 110 can include the added benefit of only allowing particular user attributes to be inputted. For example, although the user defines an age attribute or a weight attribute, the user does not decide which attributes to provide for storing in a data repository 140. Hence, a user interface 210 that is formatted only for the user to provide an age attribute and a weight attribute may have advantages. Therefore, while the user-defined physical profile 110 can contain physical attributes provided by the user, which physical attributes that are to be contained in the user-defined physical profile 110 are not decided by the user.

The set 120 of images 130 depicting an element of imperfect sport performance, where each image 130 in each set 120 depicts a different variation of the element, can be selected by the user. Such an arrangement of the user selecting the images 130 allows the user to receive sport performance evaluation without another person or device observing the user engage in sport. In operation, the one or more images 130 that resemble a particular element exhibited by the user during sport performance can be selected.

The set 120 of images 130 depicting an element of imperfect sport performance can include a wide variety of images and can be customized for a wide variety of sport. Elements of imperfect sport performance can include factors that can affect sport performance or can include the results of imperfect sport performance. An example of a set 120 of images 130 depicting an element of imperfect sport performance is a set 120 of images 130 depicting different head positions of a golfer attempting to hit a golf ball. As one skilled in the art of golf would know, head position of a golfer attempting to hit a ball is one element of a multitude of elements that can affect the performance of the golfer hitting the golf ball. That is, different head positions of the golfer will have different affects on the performance of the golfer hitting the golf ball.

Another example of a set 120 of images 130 depicting an element of imperfect sport performance can include a set 120 of images 130 depicting different trajectories for a thrown football. The images 130 can display a football that is thrown long, short, with a spiral, with a wobble, and with any other suitable characteristic. Such images 130 can depict the results of imperfect sport performance. It should be noted that the invention is not limited in this regard as any suitable set 120 of images 130 depicting an element of imperfect sport performance can be used.

The set 120 of images 130 can include a subset of elements of imperfect sport performance that displays images 130 relating to pre-action attributes of sport performance. Pre-action attributes are body configurations and interactions between a user and sport equipment that can affect sport performance. For example, in basketball, a set 120 of images 130 can depict variations of a user's stance when shooting a ball. In baseball, a set 120 of images 130 can depict variations in a user's grip of a baseball bat. It should be obvious to one skilled in the art that the invention is not limited to the examples given above as any suitable set 120 of images 130 depicting an element of imperfect sport performance can be displayed.

Additionally, the set 120 of images 130 can include another subset that displays images 130 relating to the resultant actions of sport performance. Resultant actions are events and results of events that occur because of user action. In some instances, resultant actions can be affected by the pre-action attributes. For example, in golf, the resultant action of a user striking a golf ball with a club can be a trajectory of the golf shot which can be displayed in images depicting a slice, a hook, a long shot, a short shot, or any other suitable image 130. As illustrated earlier, this resultant action can be affected by the pre-action attribute of the golfer's head position. Another resultant action of the same strike of the golf ball is the creation of a divot. In this example, a set 120 of images 130 can depict different divots, such as shallow divots, deep divots, divots with steep or gradual angles, and any other suitable divots. Again, it would be obvious to one skilled in the art that these are merely examples and that the invention is not limited in this regard as any suitable set 120 of images 130 depicting an element of imperfect sport performance can be used.

Environmental characteristics 200 also can be included in the system 100 and stored in the data repository 140. Environmental characteristics 200 can include any weather or playing conditions that can affect sport performance, such as wet surfaces, weather during play, court conditions, playing surface conditions, and any other suitable weather or playing conditions. For example, in the sport of golf, environmental characteristics 200 can include lie condition of a golf ball, such as a golf ball in soft sand, hard sand, light rough, and thick rough. Another example of an environmental characteristic 200 can be a surface inclination, such as uphill and downhill.

Storing environmental characteristics 200 in a data repository 140 for subsequent use in performing a sport performance evaluation can help to explain certain outcomes and resultant actions that appear to not correspond to the stored user-defined physical profile 110 and the stored one or more selected images 130. For example, it may be logical that a strong golfer with a proper stance can hit a golf ball a relatively long distance. If this hypothetical golfer only hits the golf ball a very short distance, the fact that the golf ball was hit from a sand trap may explain why the golf ball traveled a very short distance.

With the user-defined physical profile 110, the selection of one or more images 130 depicting an element of imperfect sport performance, and possibly the environmental characteristics 200 stored in the data repository 140, the computing device 150 can perform a sport performance evaluation and diagnose one or more causes for imperfect sport performance. In performing a sport performance evaluation and diagnosis, the data stored in the data repository 140 can be given different weights and relevance. It should be noted that not all data is considered equal in performing a sport performance evaluation and diagnosis. In basing the sport performance evaluation and diagnosis on the data in the data repository 140, different combinations of data and relationships between the data can be analyzed to find one or more causes for imperfect sport performance. As part of the process of performing a sport performance evaluation and diagnosis, the computing device 150 can generate one or more lessons 160, one or more lesson histories 170, one or more evaluation summaries 180, the post evaluation survey 190 for completion by the user, and the user diagnosis instructions 280 for completion by the user.

The evaluation summary 180 can be generated by the computing device 150 and can be presented to the user. The evaluation summary 180 can include information relating to the findings of the sport performance evaluation and the causes of imperfect sport performance. Such information can be presented in the form of text, images, sound, and even video. The evaluation summary 180 can include a listing of the information provided by the user, mechanical causes of the imperfect sport performance, such as body configuration, possible physical limitations, and interactions with equipment, other causes of imperfect sport performance, and general findings, such as a user's tendencies to perform in a particular manner. Nevertheless, it should be noted that the invention is not limited in this regard as any information relating to the findings of sport performance evaluation and the causes of imperfect sport performance can be included. Additionally, as noted earlier, the evaluation summary 180 can be stored in the data depository 140 and can be used in subsequent sport performance evaluations.

The lessons 160 can be generated by the computing device 150. The lessons 160 can include suggestions for improvement and explanations for the user's imperfect sport performance. The lessons 160 can include tutorial media, such as text, video, and audio for presenting the lesson 160 to the user. The lesson 160 can also include an identification of the physical attributes and possible physical limitations that can be mechanical reasons for imperfect sport performance. In conjunction with the identified physical attributes, the lesson 160 can provide remedies in the form of muscle and joint specific weight and resistance exercises and stretches. For example, if a basketball player has tight hamstrings resulting in a low vertical jumping height, the lesson 160 can suggest the remedy of stretching the hamstrings. The lessons 160 can also include suggested drills and practice routines to help the user improve a particular component of their sport performance. For example, a lesson 160 for a soccer player can suggest that the player juggle a soccer ball to improve ball control; however, the invention is not limited in this regard as the lesson 160 can be applied to any sport performance for any sport.

The lessons 160 can be provided by a particular entity from a bank of possible entities, where the user can specify the entity from whom the user desires to receive a lesson 160. An entity can be any source having knowledge about a sport, such as an organization, a professional trainer, a professional instructor, and a professional player. For example, the lesson 160 for a basketball player can be provided by a particular basketball player, such as Michael Jordan. In such an arrangement, a multitude of components of a lesson 160 which are provided by the entity, prior to the sport performance evaluation, can be stored in the data repository 140.

When a user requests a lesson 160 from a particular entity, the lesson 160 components provided by an entity that are relevant to the imperfect sport performance of the user can be presented to the user as at least a portion of the lesson 160. For example, a basketball player with a low vertical jumping height who desires to receive a lesson from Michael Jordan, can receive suggestions, drills, stretches, and exercises that Michael Jordan recommends to improve a low vertical jumping height. Again, it should be noted that the lesson 160 can be stored in the data repository 140 and can be used in subsequent sport performance evaluations and diagnosis.

The lesson history 170 also can be included. The lesson history 170 can include all of the contents of the past lessons 160, such as suggestions for a user to lose weight generated in a previous lesson 160 and exercises for a user to complete generated in a different previous lesson 160. The lesson history 170 can provide the user with the ability to recall past lessons 160 to review their contents. Such an arrangement can help the user to avoid having the same imperfect sport performances because a user simply forgot the teachings of a previous lesson 160. Additionally, the lesson history 170 can also allow the user to review a lesson 160 that improved a particular deficiency in their sport performance if that particular deficiency returns. Again, as stated earlier, the lesson history 170 can be stored in the data repository 140, and therefore, can affect the sport performance evaluation and diagnosis.

While performing a sport performance evaluation and diagnosis, it should be noted that the lesson history 170 can be weighted differently than more currently supplied data, such as selected images 130 that depict a current sport performance. In operation, a lesson history 170 can have a greater relevance and a corresponding weighting than currently supplied data. However, the invention is not limited in this regard because the lesson history 170 can also have a lesser relevance and a corresponding weighting than currently supplied data.

The computing device 150 can generate the post evaluation survey 190. The post evaluation survey 190 can include both questions and statements directed to elicit a user response and user responses to those questions and statements. The post evaluation survey 190 can be presented via the user interface 210 which can be formatted to receive user input and feedback regarding the effectiveness of the sport performance evaluation. Again, it should be noted that the post evaluation survey 190 can be stored in the data repository 140 and can be used in subsequent sport performance evaluations and diagnoses.

Responses to the post evaluation survey 190 can induce an additional sport performance evaluation. If the user returns feedback that their sport performance was not improved or that the sport performance evaluation was ineffective, the computing device 150 can perform an additional sport performance evaluation. In this regard, the sport performance evaluation can be based partially on the previous evaluation and the post evaluation survey 190 in an attempt to provide a different sport performance evaluation that is effective in improving the user's sport performance.

Each of the lesson 160, lesson history 170, the evaluation summary 180, and the post evaluation survey 190 can be stored in the data repository 140, and therefore, each can affect the performance evaluation. Such an arrangement can enhance the sport performance evaluation by evaluating previous stored lessons 160, stored lesson histories 170, stored evaluation summaries 180, and stored post evaluation surveys 190. In evaluating previous stored lessons 160, stored lesson histories 170, stored evaluation summaries 180, and stored post evaluation surveys 190, each previous stored lesson 160, stored lesson history 170, stored evaluation summary 180, and stored post evaluation surveys 190 can be weighted for relevance along with all other data in the data repository 140.

By evaluating the previous sport performance evaluations, the computing device 150 can perform an evaluation and factor in what previous lessons 160 benefited and did not benefit the user in the past. Additionally, by evaluating the previous sport performance evaluations, the computing device 150 can also re-evaluate the reasons why a non-benefiting lesson 160 and why a benefiting lesson 160 was generated. For example, if after performing a subsequent sport performance evaluation where the user has not improved their sport performance, the computing device 150 can generate a new and different lesson 160 than previous lessons 160. Moreover, the computing device 150 can also re-evaluate the previous sport performance evaluation to avoid a variety of possible faulty reasoning, or inaccurate or incomplete data used in generating the previous lesson 160.

In one embodiment, secondary data 220 can be stored in the data repository 140. Secondary data 220 can include one or more of additional user-defined physical profile data 230, one or more additionally selected images 240, one or more additional environmental characteristics 250, one or more secondary post evaluation surveys 260, and a combination thereof. In operation, secondary data 220 can be stored in the data repository 140 to enhance diagnosing at least one cause for imperfect sport performance. The secondary data 220 can provide a more complete and more specific description of a sport performance to diagnose.

Additionally, the secondary data 220 can be based on data previously stored in the data repository 140. In one example, if the stored user-defined physical profile 110 contains data indicating the user has a disability, secondary data 220, particularly additional user-defined physical profile data 230, can be stored in the data repository 140 to reflect specific characteristics regarding the disability. For example, additional user-defined physical profile data 230 can indicate that the disability is arthritis, causing the patient to have limited range of joint motion affecting sport performance, or that the user only has one arm, causing balancing problems for the user and also affecting sport performance. It should be noted that the invention is not limited in this regard as the additional user-defined physical profile data 230 is not limited to any disability, or to even a disability, as any suitable additional user-defined physical profile data 230 can be included. Additionally, the secondary data 220 can be weighted for performing a sport performance evaluation and diagnosis. In the previous example of the user with arthritis, weighting the secondary data 220 can be quite advantageous in performing a sport performance evaluation and diagnosis.

In another example of how the secondary data 220 can be based on data previously stored in the data repository 140, the one or more stored environmental characteristics 200 can indicate that the temperature during sport performance is cold. While some users may vary in describing what constitutes cold, secondary data 220, particularly one or more additional environmental characteristics 250 can be stored in the data repository 140 to reflect a more specific temperature, or perhaps, whether snow was present during sport performance. Again, it should be noted that the invention is not limited in this regard as one or more additional environmental characteristics 250 are not limited to temperature and any suitable one or more additional environmental characteristics 250 can be included.

In another embodiment, one or more illogical selections 270 of the one or more images 130, an illogical physical user-defined physical profile 120, an illogical post evaluation survey 190, and a combination thereof can be detected. Detecting one or more illogical selections 270 can be based on the data already stored in the data repository 140. An illogical selection 270 is any selection or input of data that does not correspond to common relationships with the stored data, as such common relationships are known in the relevant sport.

For example, in golfing, a present selection, such as an image depicting an extremely deep divot, can be compared to other selected images 130. Such a selection can be illogical if other selected images 130 depict the user in a putting stance, because a user will normally not create a divot when putting. In a different example, the user-defined physical profile 110 may indicate that the user has a height of six feet and 5 inches. While such a body configuration is possible, a weight of one hundred pounds can be illogical for a person of such a height. It should be noted that detecting one or more illogical selections 270 is not limited to the previous examples as an illogical selection can be detected for any illogical selection 270.

Additionally, the illogical selections 270 can be replaced by secondary data 220. Replacing the illogical selections 270 with secondary data 220 removes the illogical selections from the sport performance evaluation. Removing the illogical selections 270 provides the benefit of an accurate and individualized sport performance evaluation. For example, if the sport performance evaluation is based upon a user-defined physical profile 110 that includes an illogical weight attribute, the sport performance evaluation will not provide an accurate diagnosis for the user.

The secondary data 220, including the additional user-defined physical profile data 230, one or more additionally selected images 240, one or more additional environmental characteristics 250, one or more secondary post evaluation surveys 260 can be combined, respectively, with the stored user-defined physical profile 110, one or more stored selected images 130, one or more stored environmental characteristics 200, and one or more stored post evaluation surveys 190. For example, the additional physical profile data 230 can be combined with the stored user-defined physical profile 110. Hence, in a combined arrangement, the stored user-defined physical profile 110 can include additional user-defined physical profile data 230.

In a like manner, one or more additionally selected images 240 can be combined with the one or more stored selected images 130. Consequently, the stored one or more selected images 130 can include one or more additionally selected images 240. Likewise, one or more additional environmental characteristics 250 can be combined with one or more stored environmental characteristics 200. Therefore, the one or more stored environmental characteristics 200 can include the one or more additional environmental characteristics 250.

Such an arrangement where additional user-defined physical profile data 230, one or more additionally selected images 240, one or more additional environmental characteristics 250, and one or more secondary post evaluation surveys 260 can be respectively combined with the stored user-defined physical profile 110, one or more stored selected images 130, one or more stored environmental characteristics 200, and one or more stored post evaluation surveys 190 can offer a benefit of an enhanced sport performance evaluation and diagnosis of at least one cause for imperfect sport performance. The sport performance evaluation and diagnosis can be based on the data in the data repository 140, however, the data in the data repository 140 can include secondary data 220.

In another embodiment, one or more user diagnosis instructions 280 can be generated and stored in the data repository 140. User diagnosis instructions 280 are any instructions that direct a user to perform a certain task or evaluate a portion of their sport performance and then direct the user to provide one or more user diagnosis results 290. One or more user diagnosis results 290 can be any description of the findings or outcomes of following the user diagnosis instructions 280. For example, user diagnosis instructions 280 can direct a user to test their hamstring flexibility by directing a user to attempt to touch their toes with their legs in a straight position. The user can then report the findings or outcomes of the user diagnosis instructions 280 as user diagnosis results 290, which can be stored in the data repository 140. However, it should be noted that the one or more user diagnosis instructions 280 are not limited to physical attributes such as flexibility, as the one or more user diagnosis instructions 280 can relate to any other suitable physical attribute and element of sport performance. Furthermore, similar to other configurations of the user interface 210, the user interface 210 can be configured to receive the user diagnosis results 290.

Additionally, the one or more user diagnosis results 290 can be stored in the data repository 140 and can be given a relevance weighting for use in diagnosis and sport performance evaluation. Therefore, similar to the other data stored in the data repository 140, the sport performance evaluation and diagnosis can be based on the one or more stored user diagnosis results 290.

Although the present invention has been described in conjunction with the embodiments disclosed herein, it should be understood that the foregoing description is intended to illustrate and not limit the scope of the invention as defined by the claims.

What is claimed is:

1. A sport performance evaluation method, the method comprising the steps of:

storing a user-defined physical profile;

displaying a set of images, each image in said set depicting a different variation of an element of imperfect sport performance;

selecting at least one image in said set most closely depicting an element of imperfect sport performance exhibited by a user who is associated with said user-defined physical profile; and diagnosing at least one cause for said imperfect sport performance based upon said at least one selected image and said stored user-defined physical profile.

2. The method according to claim 1, further comprising the step of storing at least one environmental characteristic;

wherein said diagnosing step is additionally based upon said at least one stored environmental characteristic.

3. The method according to claim 2, further comprising the step of storing secondary data;

wherein said secondary data comprises at least one of additional user-defined physical profile data, at least one additional selected image, and at least one additional environmental characteristic; and wherein said diagnosing step is additionally based upon said stored secondary data.

4. The method according to claim 1, further comprising the step of generating at least one of a lesson and an evaluation summary;

wherein said lesson and said evaluation summary are based upon said diagnosis.

5. The method according to claim 4, further comprising the step of storing at least one of said lesson and said evaluation summary;

wherein said diagnosing step is additionally based upon at least one of said stored lesson and said stored evaluation summary.

6. The method according to claim 5, further comprising the step of presenting at least one of said stored lesson and said stored evaluation summary.

7. The method according to claim 1, further comprising the step of storing in said data repository a post evaluation survey;

wherein said diagnosing step is additionally based upon said stored post evaluation survey.

8. The method according to claim 7, further comprising the step of storing secondary data;

wherein said secondary data comprises at least one secondary post evaluation survey; and wherein said diagnosing step is additionally based upon said stored secondary data.

9. The method according to claim 7, further comprising the step of detecting at least one of an illogical selection of said at least one image, an illogical user-defined physical profile, and an illogical post evaluation survey.

10. The method according to claim 1, further comprising the step of generating at least one user diagnosis instruction for instructing said user to provide at least one user diagnosis result.

11. The method according to claim 10, further comprising the step of storing at least one user diagnosis result;

wherein said diagnosing step is additionally based upon said stored at least one user diagnosis result.

12. A system for sport performance evaluation, comprising:

a user-defined physical profile, at least one set of images depicting an element of imperfect sport performance, each image in said set depicting a different variation of said element, at least one data repository configured to store at least said at least one selected image and said user-defined physical profile; and at least one computing device coupled to said at least one data repository and programmed to perform a sport performance evaluation based upon at least said stored at least one selected image and said stored user-defined physical profile.

13. The system according to claim 12, further comprising at least one lesson, at least one evaluation summary, at least one post evaluation survey, at least one lesson history, at least one environmental characteristic, at least one secondary data, at least one user diagnosis instruction, and at least one user diagnosis result;

wherein said at least one lesson, said at least one evaluation summary, said at least one post evaluation survey, said at least one lesson history, said at least one environmental characteristic, said at least one secondary data, said at least one secondary data, said at least one user diagnosis instruction, and said at least one user diagnosis result are stored in said at least one data repository.

14. The system according to claim 13, wherein said at least one computing device is programmed to perform a sport performance evaluation based additionally upon at least one of said stored at least one lesson, said stored at least one evaluation summary, said stored at least one post evaluation survey, said stored at least one lesson history, said stored at least one environmental characteristic, said stored at least one secondary data, said stored at least one user diagnosis instruction, and said stored at least one user diagnosis result.

15. The system according to claim 14, further comprising at least one user interface.

16. A system according to claim 15, wherein said at least one user interface is configured to accept at least one of said user-defined physical profile, a selection of said at least one image depicting an element of imperfect sport performance, said at least one post evaluation survey, said at least one environmental characteristic, said at least one secondary data, and said at least one user diagnosis result.

17. The system according to claim 15, wherein said at least one user interface presents at least one of said stored user-defined physical profile, said stored at least one set of images depicting an element of imperfect sport performance, said stored at least one lesson, said stored at least one lesson history, said stored at least one evaluation summary, said stored at least one post evaluation survey, said stored at least one environmental characteristic, said stored at least one secondary data, and said stored at least one user diagnosis instruction.

18. A system according to claim 12, further comprising a plurality of networked computing devices;

wherein at least one computing device is configured for user access.

* * * * *